US008544152B2

(12) United States Patent
Hsu

(10) Patent No.: US 8,544,152 B2
(45) Date of Patent: Oct. 1, 2013

(54) ROTATING MECHANISM FOR PRINTING APPARATUS

(75) Inventor: Wen-Hsien Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 31 days.

(21) Appl. No.: 13/237,306

(22) Filed: Sep. 20, 2011

(65) Prior Publication Data

US 2012/0297576 A1 Nov. 29, 2012

(30) Foreign Application Priority Data

May 27, 2011 (TW) ..... 100118767 A

(51) Int. Cl.
*E05D 11/06* (2006.01)

(52) U.S. Cl.
USPC ..... 16/374; 16/319

(58) Field of Classification Search
USPC ..... 16/374, 223, 319, 337, 297, 363; 271/7, 198
See application file for complete search history.

(56) References Cited

U.S. PATENT DOCUMENTS

| | | | | |
|---|---|---|---|---|
| 4,227,283 | A * | 10/1980 | Mathewson et al. | 16/273 |
| 5,121,521 | A * | 6/1992 | Hagiwara et al. | 16/278 |
| 5,292,113 | A * | 3/1994 | Morigami et al. | 271/7 |
| 6,530,122 | B1 * | 3/2003 | Kondou et al. | 16/335 |
| 7,887,019 | B2 * | 2/2011 | Yeh et al. | 248/372.1 |
| 2007/0089271 | A1 * | 4/2007 | Jo et al. | 16/286 |
| 2007/0251056 | A1 * | 11/2007 | Aoyagi | 16/221 |

FOREIGN PATENT DOCUMENTS

JP 2010134230 A * 6/2010

* cited by examiner

*Primary Examiner* — William Miller
(74) *Attorney, Agent, or Firm* — Altis & Wispro Law Group, Inc.

(57) ABSTRACT

A rotating mechanism for a printing apparatus includes a fixing member and a rotating member fixed on the fixing member. The fixing member includes a rotating pole and a stop portion on one side of the rotating pole. The rotating member includes a rotating portion and a resisting portion extended from a bottom of the rotating portion. The rotating portion is fixed between the rotating pole and the stop portion and abuts the rotating pole to fix the rotating member on the fixing member. The rotating portion rotates along a first direction relative to the rotating pole between an original position and a first position. Wherein in the first direction to a first position, the rotating portion is parallel to the stop portion and the resisting portion abuts the stop portion to prevent the rotating portion rotating along the first direction relative to the rotating pole.

18 Claims, 4 Drawing Sheets

ROTATING MECHANISM FOR PRINTING APPARATUS

BACKGROUND

1. Technical Field

The present disclosure relates to rotating mechanisms, and particularly to a rotating mechanism for printing apparatuses.

2. Description of Related Art

In multifunction or all-in-one printers, fax machines, photocopiers and scanners, an automatic document feeder or ADF is a feature which takes several pages and feeds the paper one page at a time into a scanner or copier, allowing the user to scan, and thereby copy, print, or fax, multiple-page documents without having to manually replace each page. In a typical all-in-one printer, the ADF module is fixed on the all-in-one printer via a floating hinge. The floating hinge is secured on the all-in-one printer by screws, which is very complicated and time-consuming to assemble.

Therefore there is a need for improvement in the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
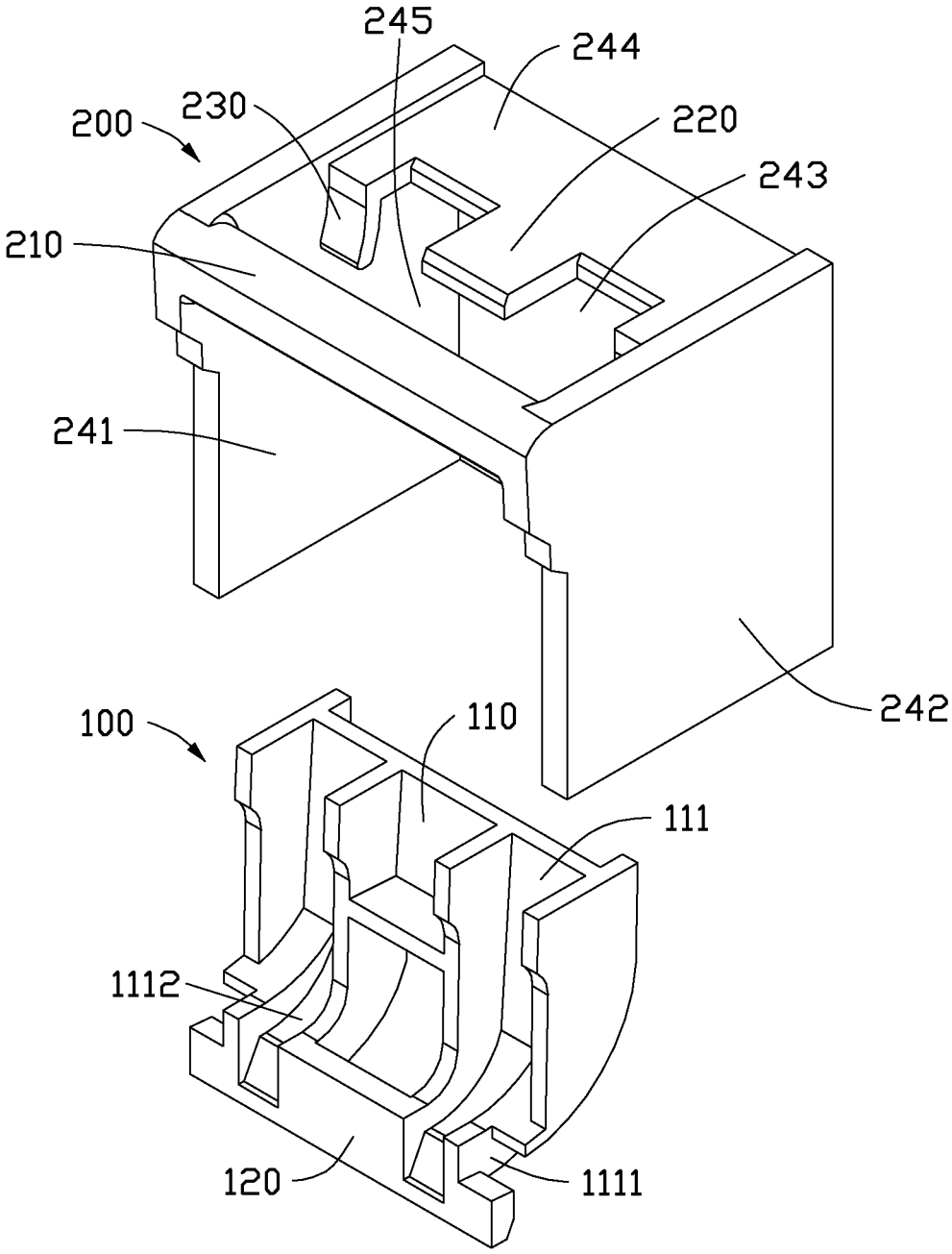
FIG. 1 is an exploded and isometric view of a rotating mechanism for a printing apparatus, in accordance with an embodiment.
Figure 2:
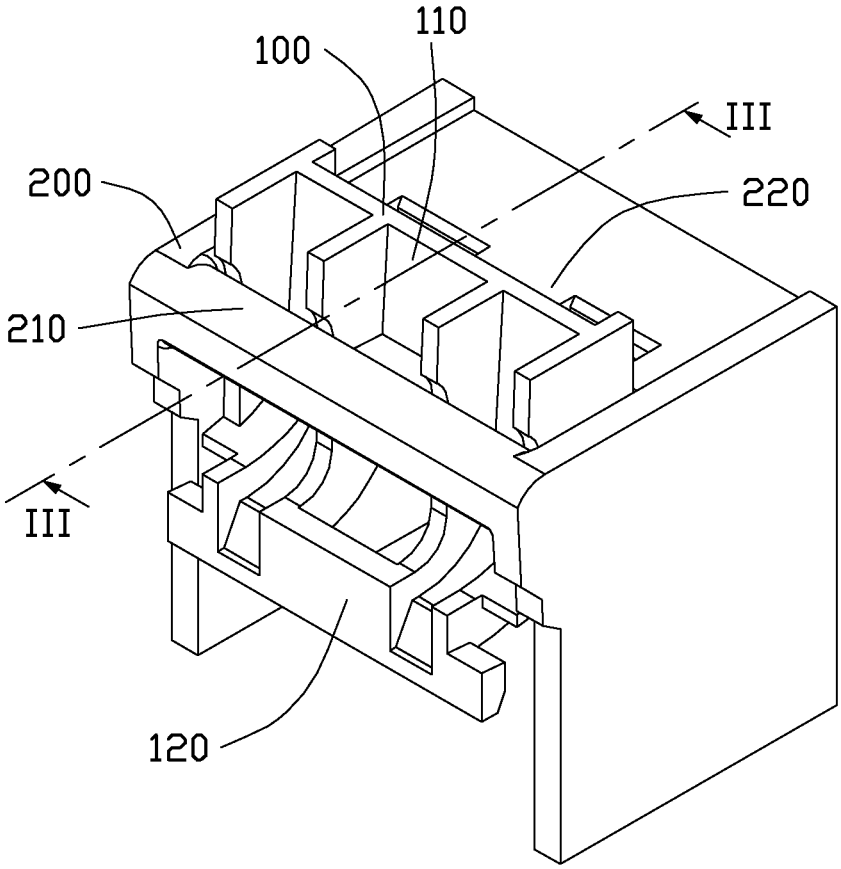
FIG. 2 is an assembled view of FIG. 1.

Referring to FIG. 1, a rotating mechanism for printing apparatus is used to open and close a printing apparatus (not shown) and includes a rotating member 100 and a fixing member 200.

The rotating member 100 includes a rotating portion 110 and a resisting portion 120 extended from a bottom of the rotating portion 110. The fixing member 200 includes a rotating pole 210, a stop portion 220, and two guiding portions 230 on two sides of the stop portion 220. The rotating portion 110 is fixed between the rotating pole 210 and the stop portion 220. The rotating portion 110 abuts the rotating pole 210 to fix the rotating member 100 on the fixing member 200. The rotating portion 110 is capable of rotating counterclockwise relative to the rotating pole 210. In one embodiment, the rotating member 100 is fixed on a cover plate (not shown) of the printing apparatus; and the fixing member 200 is fixed on a base of the printing apparatus.

The rotating portion 110 includes two arched rotating arms 111. Each rotating arm 111 defines an arced first slot 1111, on one side, corresponding to the guiding portion 230. Each rotating arm 111 defines a plurality of second slots 1112 on a back corresponding to the rotating pole 210. When the rotating portion 110 is rotated counterclockwise relative to the rotating pole 210, the guiding portion 230 slides in the corresponding first slot 1111, and the rotating pole 210 slides in the plurality of second slots 1112.

The fixing member 200 includes two parallel sidewalls 241, 242, a connection wall 243 perpendicularly connected between the sidewalls 241, 242, and a top wall 244 perpendicularly connected between the sidewalls 241, 242. The rotating pole 210 is perpendicularly connected between the sidewalls 241, 242. The rotating pole 210 and the top wall 244 cooperatively form an opening 245 therebetween. The stop portion 220 extends from the middle of a side edge of the top wall 244. The guiding portions 230 extend from the side edge of the top wall 244 on two sides of the stop portion 220.

Figure 3:
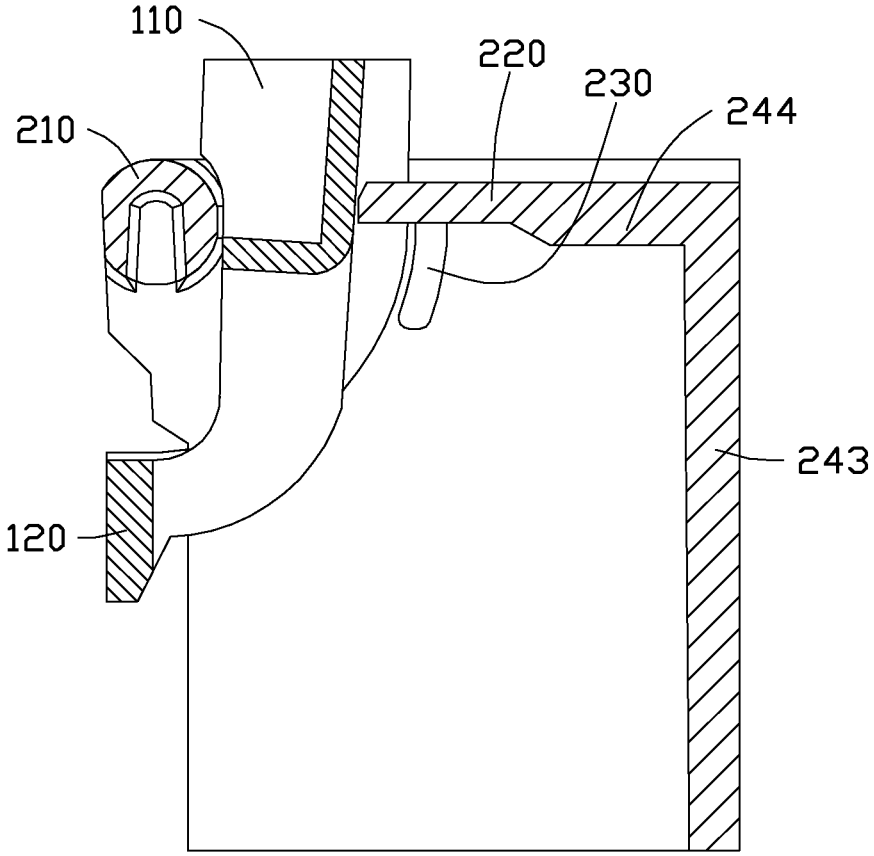
FIG. 3 is a sectional view of the rotating mechanism for printing apparatus of FIG. 1, taken along line III-III when the printing apparatus is open.

Referring to FIG. 3, when the rotating member 100 is located on the fixing member 200 at an original position, the cover plate of the printing apparatus is closed and joined with the base of the printing apparatus. The rotating portion 110 is perpendicular to the stop portion 220. The resisting portion 120 is separated from the stop portion 220.

Figure 4:
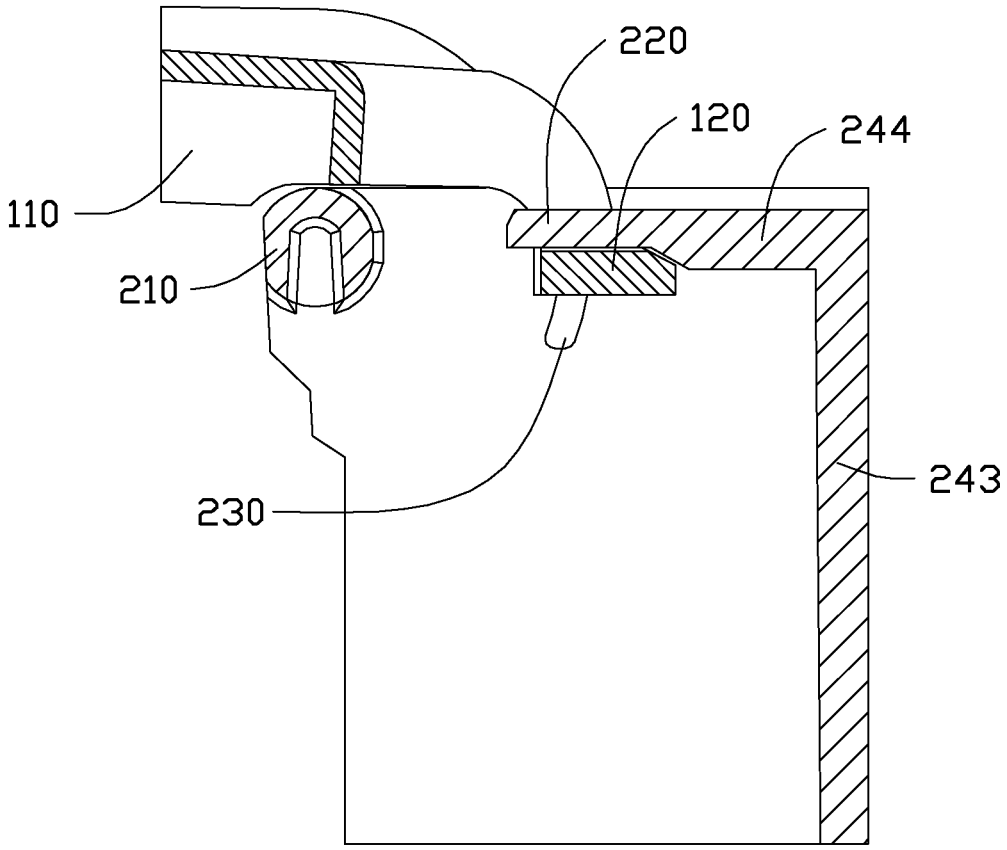
FIG. 4 is similar to FIG. 3 but with the printing apparatus closed.

Referring to FIG. 4, when the cover plate of the printing apparatus is turned on, the cover plate is lifted up to rotate the rotating member 100 counterclockwise relative to the fixing member 200. When the rotating portion 110 is rotated to a first position relative to the rotating pole 210, the cover plate is opened on and separated from the base. The rotating portion 110 is parallel to the stop portion 220. The resisting portion 120 abuts the stop portion 220 to prevent the rotating portion 110 rotating counterclockwise relative to the rotating pole 210.

Even though numerous characteristics and advantages of the present disclosure have been set forth in the foregoing description, together with details of the structure and function of the disclosure, the disclosure is illustrative only, and changes may be made in detail, especially in matters of shape, size, and the arrangement of parts within the principles of the disclosure to the full extent indicated by the broad general meaning of the terms in which the appended claims are expressed.

What is claimed is:

1. A rotating mechanism for a printing apparatus comprising:

a fixing member, comprising:

a rotating pole;

a stop portion spaced from and positioned on one side of the rotating pole; and a rotating member fixed on the fixing member, the rotating member comprising:

a rotating portion adapted to rotate along a first direction relative to the rotating pole between an original position and a first position;

a resisting portion extended from a bottom of the rotating portion; wherein the rotating portion is fixed between the rotating pole and the stop portion to abut the rotating pole and fix the rotating member on the fixing member, wherein in the original position, the rotating portion is perpendicular to the stop portion, the resisting portion is separated from the stop portion; and in the first position, the rotating portion is parallel to the stop portion and the resisting portion abuts the stop portion to prevent the rotating portion rotating along the first direction relative to the rotating pole.

2. The rotating mechanism of claim 1, wherein the rotating portion comprises two rotating arms, each rotating arm defines a first slot on one side; the fixing member further comprises two guiding portions on two sides of the stop portion; and when the rotating portion is rotated along the first direction relative to the rotating pole, the two guiding portions slide in the first slots.

3. The rotating mechanism of claim 2, wherein each rotating arm defines a plurality of second slots on a back of the rotating arm corresponding to the rotating pole; and when the rotating portion is rotated along the first direction relative to the rotating pole, the rotating pole slides in the plurality of second slots.

4. The rotating mechanism of claim 1, wherein the fixing member comprises two parallel sidewalls and a connection wall perpendicularly connected the two parallel sidewalls, and the rotating pole is perpendicularly connected the two parallel sidewalls.

5. The rotating mechanism of claim 4, wherein the fixing member further comprises a top wall perpendicularly connected the two parallel sidewalls, the rotating pole and the top wall cooperatively form an opening therebetween, the stop portion extends from the middle of a side edge of the top wall, and two guiding portions extend from the side edge of the top wall on two sides of the stop portion.

6. The rotating mechanism of claim 1, wherein the first direction is a counterclockwise direction.

7. A rotating mechanism for a printing apparatus comprising:

a fixing member, comprising:

a rotating pole;

a stop portion spaced from and positioned on one side of the rotating pole; and a rotating member fixed on the fixing member, the rotating member comprising:

a rotating portion adapted to rotate along a first direction relative to the rotating pole between an original position and a first position;

a resisting portion extended from a bottom of the rotating portion; wherein the rotating portion is fixed between the rotating pole and the stop portion to abut the rotating pole and fix the rotating member on the fixing member;

wherein in the first position, the rotating portion is parallel to the stop portion and the resisting portion abuts the stop portion to prevent the rotating portion rotating along the first direction relative to the rotating pole.

8. The rotating mechanism of claim 7, wherein the rotating portion comprises two rotating arms, each rotating arm defines a first slot on one side, the fixing member further comprises two guiding portions on two sides of the stop portion; and when the rotating portion is rotated along the first direction relative to the rotating pole, the two guiding portions slide in the first slots.

9. The rotating mechanism of claim 8, wherein each rotating arm defines a plurality of second slots on a back of the rotating arm corresponding to the rotating pole; and when the rotating portion rotated along the first direction relative to the rotating pole, the rotating pole slides in the plurality of second slots.

10. The rotating mechanism of claim 7, wherein the fixing member comprises two parallel sidewalls and a connection wall perpendicularly connected the two parallel sidewalls, and the rotating pole is perpendicularly connected the two parallel sidewalls.

11. The rotating mechanism of claim 10, wherein the fixing member further comprises a top wall perpendicularly connected the two parallel sidewalls, the rotating pole and the top wall cooperatively form an opening therebetween, the stop portion extends from the middle of a side edge of the top wall and two guiding portions extend from the side edge of the top wall on two sides of the stop portion.

12. The rotating mechanism of claim 7, wherein when the rotating member is located on the fixing member at the original position, the rotating portion is perpendicular to the stop portion and the resisting portion is separated from the stop portion.

13. The rotating mechanism of claim 7, wherein the first direction is a counterclockwise direction.

14. A rotating mechanism for a printing apparatus comprising:

a fixing member, comprising:

a rotating pole;

a stop portion spaced from and positioned on one side of the rotating pole; and a rotating member fixed on the fixing member, the rotating member comprising:

a rotating portion adapted to rotate along a first direction relative to the rotating pole between an original position and a first position;

a resisting portion extended from a bottom of the rotating portion; wherein the rotating portion is fixed between the rotating pole and the stop portion to abut the rotating pole and fix the rotating member on the fixing member;

wherein in the first position, the rotating portion is parallel to the stop portion and the resisting portion abuts the stop portion to prevent the rotating portion from rotating along the first direction relative to the rotating pole; and when the rotating member is located on the fixing member at the original position, the rotating portion is perpendicular to the stop portion and the resisting portion is separated from the stop portion.

15. The rotating mechanism of claim 14, wherein the rotating portion comprises two rotating arms, each of the two rotating arms defines a first slot on one side, the fixing member further comprises two guiding portions on two sides of the stop portion; and when the rotating portion is rotated along the first direction relative to the rotating pole, the two guiding portions slide in the first slots.

16. The rotating mechanism of claim 15, wherein each of the two rotating arms defines a plurality of second slots on a back of each of the two rotating arms corresponding to the rotating pole; and when the rotating portion rotated along the first direction relative to the rotating pole, the rotating pole slides in the plurality of second slots.

17. The rotating mechanism of claim 14, wherein the fixing member comprises two parallel sidewalls and a connection wall perpendicularly connected the two parallel sidewalls, and the rotating pole is perpendicularly connected the two parallel sidewalls.

18. The rotating mechanism of claim 17, wherein the fixing member further comprises a top wall perpendicularly connected the two parallel sidewalls, the rotating pole and the top wall cooperatively form an opening therebetween, the stop portion extends from the middle of a side edge of the top wall and two guiding portions extend from the side edge of the top wall on two sides of the stop portion.

* * * * *